US007350274B2

(12) United States Patent
Rogers

(10) Patent No.: US 7,350,274 B2
(45) Date of Patent: Apr. 1, 2008

(54) REMOVABLE HAT ACCESSORY

(75) Inventor: James Ray Rogers, Rancho Cucamonga, CA (US)

(73) Assignee: Namkung Promotions, Inc., Costa Mesa, CA (US)

( * ) Notice: Subject to any disclaimer, the term of this patent is extended or adjusted under 35 U.S.C. 154(b) by 643 days.

(21) Appl. No.: 10/645,368

(22) Filed: Aug. 21, 2003

(65) Prior Publication Data

US 2005/0039308 A1 Feb. 24, 2005

(51) Int. Cl.
*A44B 1/14* (2006.01)
*A44B 1/04* (2006.01)

(52) U.S. Cl. ..... 24/113 MP; 24/113 R

(58) Field of Classification Search ..... 24/3.1, 24/3.12, 90.1, 113 R, 113 MP, 56, 61, 64, 24/66.2, 66.4; 2/171, 171.1, 209.11, 209.13, 2/244, 422, 909, 918
See application file for complete search history.

(56) References Cited

U.S. PATENT DOCUMENTS

| | | | | | |
|---|---|---|---|---|---|
| 581,111 | A | * | 4/1897 | Goodwin | 40/315 |
| 2,454,103 | A | * | 11/1948 | Swidersky | 24/459 |
| 2,611,902 | A | | 9/1952 | Rockmore | |
| 2,751,654 | A | * | 6/1956 | Armbruster | 24/113 MP |
| 2,834,080 | A | * | 5/1958 | Corbi | 40/315 |
| 3,077,051 | A | | 2/1963 | Quinones, Jr. | |
| 3,106,184 | A | | 10/1963 | Shea | |
| 3,343,230 | A | * | 9/1967 | Darvie | 24/113 R |
| 4,918,791 | A | * | 4/1990 | Hardin | 24/90.5 |
| 5,060,356 | A | * | 10/1991 | Szedzinski | 24/113 R |
| 5,070,546 | A | | 12/1991 | Stazo | |
| 5,088,127 | A | | 2/1992 | Thornock | |
| D325,941 | S | | 5/1992 | Bertrand | |
| 5,161,285 | A | * | 11/1992 | Jerjian | 24/113 R |
| D356,205 | S | | 3/1995 | Amato | |
| 5,394,719 | A | * | 3/1995 | Fang | 63/33 |
| D365,916 | S | | 1/1996 | Hutchinson | |
| D366,751 | S | | 2/1996 | Gravante | |
| D370,333 | S | | 6/1996 | Lewis | |
| 5,542,157 | A | * | 8/1996 | Herman | 24/113 MP |
| 5,561,864 | A | | 10/1996 | DeMars | |
| D376,468 | S | | 12/1996 | Berman | |
| 5,621,951 | A | * | 4/1997 | Gould | 24/90.5 |
| D391,389 | S | | 3/1998 | Ramirez, Jr. | |
| 5,734,991 | A | | 4/1998 | Schmid | |
| D397,839 | S | | 9/1998 | Lettieri | |
| D399,037 | S | | 10/1998 | Davis, III | |
| 5,903,927 | A | | 5/1999 | Wolfe | |
| D410,318 | S | | 6/1999 | Chen | |
| D410,690 | S | | 6/1999 | Pratt | |
| 6,049,912 | A | | 4/2000 | Linehan | |
| 6,279,167 | B1 | | 8/2001 | Johnson | |
| D454,678 | S | | 3/2002 | Graves | |
| 6,381,806 | B1 | * | 5/2002 | Stanesic et al. | 16/4 |
| 6,857,167 | B2 | * | 2/2005 | Bishop | 24/66.2 |

* cited by examiner

*Primary Examiner*—Katherine Mitchell
*Assistant Examiner*—Ruth C. Rodriguez
(74) *Attorney, Agent, or Firm*—Stetina Brunda Garred & Brucker

(57) ABSTRACT

An accessory device that can be removably attached to the button of a hat. The device includes a base with an opening that extends at least partially through the base. The device can be attached to the hat by pushing the button of the hat into the opening of the device. Friction between the inner surface of the opening and the button securely holds the device to the hat.

11 Claims, 6 Drawing Sheets

Fig. 18
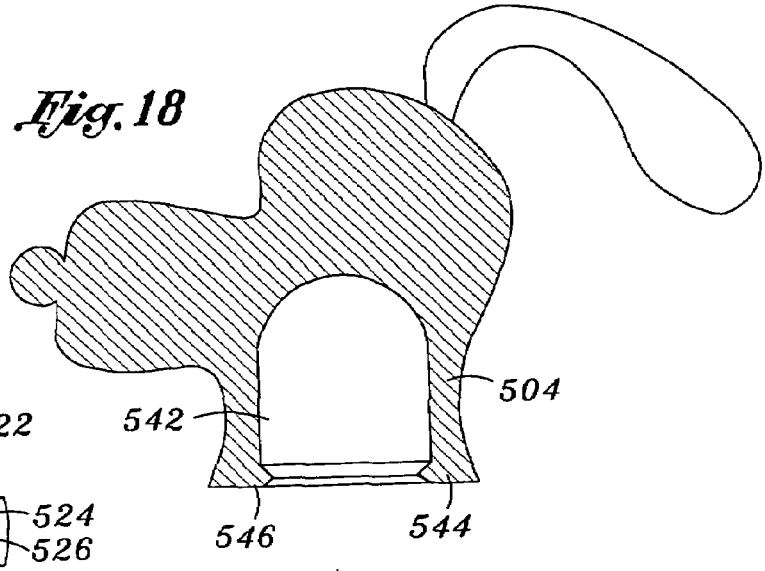
Fig. 19
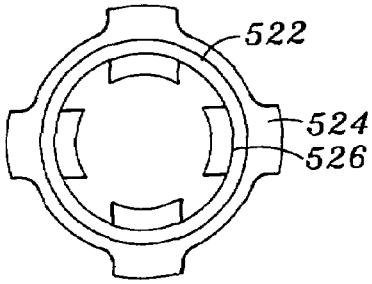
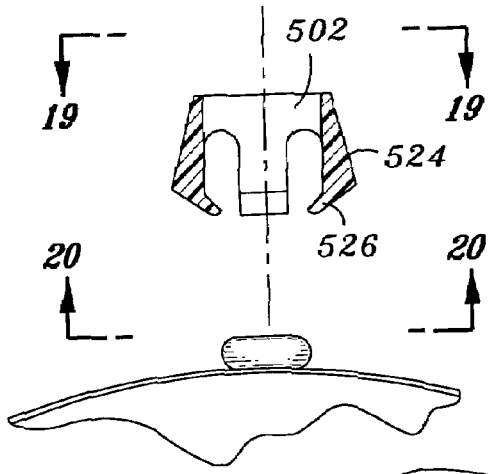
Fig. 20
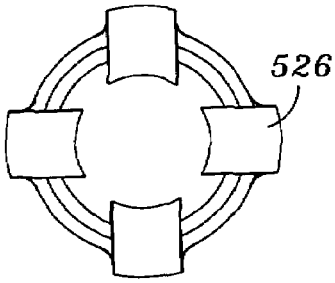
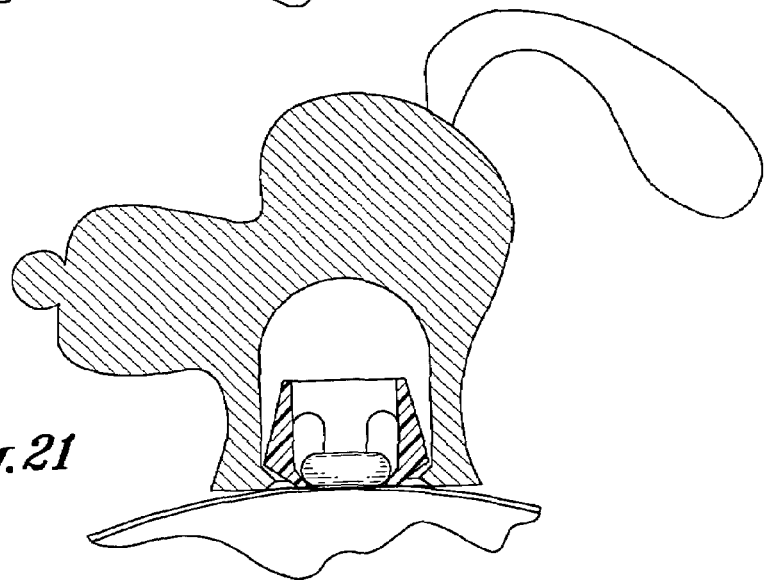
Fig. 21

REMOVABLE HAT ACCESSORY

CROSS-REFERENCE TO RELATED APPLICATIONS NOT APPLICABLE

STATEMENT RE: FEDERALLY SPONSORED RESEARCH/DEVELOPMENT NOT APPLICABLE

BACKGROUND OF THE INVENTION

The present invention generally relates to hat accessories, and more specifically relates to a hat accessory that can be removably attached to the central button found on conventional hats/caps.

It is well understood that many people wear hats. Sometimes, persons attach objects to their hats in order to make them more visually appealing, for displaying promotions, for comedic effect, and for a variety of other reasons. Many hats, especially baseball-style caps, typically include a central button at its apex, and this button provides a convenient means of attaching various accessories to the hat.

Multiple products have been designed to be attached to the button on top of a hat/cap. For instance, U.S. Pat. No. 5,530,970 to Knutson discloses a display object attached to a spring, and by rotating and pushing the spring on the hat button, one or more of the spring coils advances past the button and returns to its original diameter underneath the button. As such, interference between the button and the bottom coils of the spring secures the Knutson device to the hat.

Also, U.S. Pat. No. 5,070,546 to Stazo discloses a device with a thin-walled bottom member that includes a hole with slits or slots radially extending therefrom. The slits or slots allow the portion of the bottom member surrounding the hole to deform when pushing the button into the hole. Such deformation allows the button to advance past the bottom member, and the bottom member returns to its original shape. Thus, interference between the bottom member and the button secure the Stazo device to the hat. As such, both the Knutson and Stazo patents disclose objects that can be removably attached to the button of a hat/cap due to interference between the button and the patented device itself.

However, since the Knutson and Stazo devices both include members that locally flex in order to achieve an interference fit, repeated attachment and removal (i.e., repeated flexure) can eventually lead to failure of the devices. For instance, since the same spring coils of the Knutson device must cyclically flex during attachment and removal, repeatedly attaching and removing the device can cause the coils to permanently deform to an extent that the unloaded diameter of the coils is larger than the diameter of the button. Likewise, repeated attachment and removal of the Stazo device can eventually fracture the portion of the bottom member surrounding the hole. In both cases, a secure interference fit between the respective device and the button can no longer be achieved.

Therefore, there exists a substantial need in the art for a hat/cap accessory that can be easily and repeatedly attached and removed to the central button of the cap simply attaching mechanism.

BRIEF SUMMARY OF THE INVENTION

The present invention provides an accessory device that can be removably attached to a button of a hat. The accessory comprises a base for releasably attaching to the hat, and a display object attached to the base. In one embodiment, the base includes an opening that extends at least partially through the base, and the opening is sized so as to extend axially over and frictionally engage the button. The opening includes a round aperture, a square aperture or an aperture in different geometry. Preferably, the diameter of the aperture is smaller than the diameter of the button. For example, the diameter of the aperture measures approximately between ½ and ⅝ inches. The accessory can be formed via injection molding processes, and the display object is a figurine, for example.

In another embodiment of the present invention, the base is an attaching unit for attaching the accessory device to the hat and attaching the display object thereto. The attaching unit includes a base unit for attaching to the hat, and a snap-on unit for attaching the display object thereto. The base unit includes a bottom plate slidable underneath the button, and a lower latching structure protruding from the bottom plate. The snap-on unit includes an upper latching structure at an interior surface thereof for engaging with the lower latching structure, and a snap-on structure at an exterior surface thereof for attaching the display object thereto. The base unit and the snap-on unit are connected to each other by a foldable bar functioning as a hinge. Therefore, by folding the foldable bar, the snap-on unit is placed over the base unit to be attached thereto. Preferably, the snap-on unit and the foldable bar are integrally formed. The periphery of the base unit is smaller than the periphery of the snap-on unit. The display object comprises a bottom rim mating the snap-on structure. The bottom plate includes a slot recessed from a periphery thereof, and the lower latching structure includes an opening aligned over the slot. The snap-on unit further comprises a lid aligned with the opening when the upper latching structure is engaged with the lower latching structure.

In yet another embodiment of the present invention, the base comprises a top frame, a plurality of snap-on arms extending downwardly from the edge of the top frame, and the bottom of each arm is contracted and slanted inwardly. The display object includes a lower hollow portion that defines a bottom rim, and the bottom rim includes a flexibly latching structure at an interior side thereof for latch the snap-on arms therein. Therefore, the depth of the lower hollow portion is preferably larger than that of the base. The bottoms of the arms form a set of gripping clips.

The present invention further provides an accessory device that can be removably attached to a button of a hat. The accessory device is partitioned into a first part and a second part. The first part includes a first side surface defining a first edge, and a first bottom surface that includes a first notch. The second part includes a second side surface defining a second edge conformal to the first edge, and a second bottom surface that includes a second notch. When the first and second parts are joined together with the first and second edges aligned with each other, the first and second notches define a slot with a diameter smaller than the button.

In one embodiment, the first part and the second part are partly connected to each other at a hinge point. Preferably, at least one part of the first edge is resiliently connected to a corresponding part of the second edge at a hinge point. Therefore, the first and second parts can be unfolded open, or folded to join about the hinge point. Alternatively, the first and second parts may comprise at least a pair of latching devices along the first and second edges thereof.

BRIEF DESCRIPTION OF THE DRAWINGS

These as well as other features of the present invention will become more apparent upon reference to the drawings wherein:

FIG. 18 shows an exploded view of an accessory device to be attached to a hat/cap in a fifth embodiment of the present invention;

FIG. 19 shows a top view of the attaching means used to attach the accessory device to the hat/cap;

FIG. 20 shows a bottom view of the attaching means used to attach the accessory device to the hat/cap; and FIG. 21 the accessory device attached to the hat/cap.

DETAILED DESCRIPTION OF THE INVENTION

Figure 1:
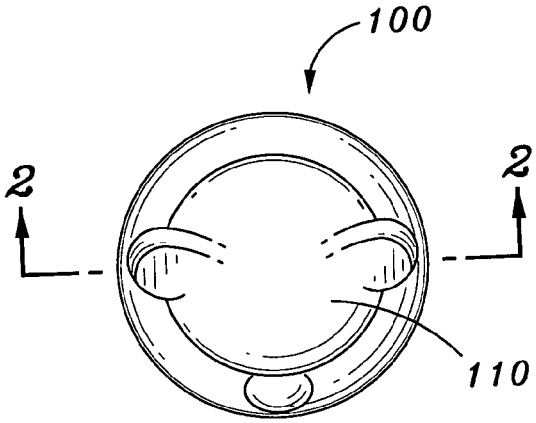
FIG. 1 is a top view of an accessory device that can be frictionally secured to the central button of a hat/cap.
Figure 2:
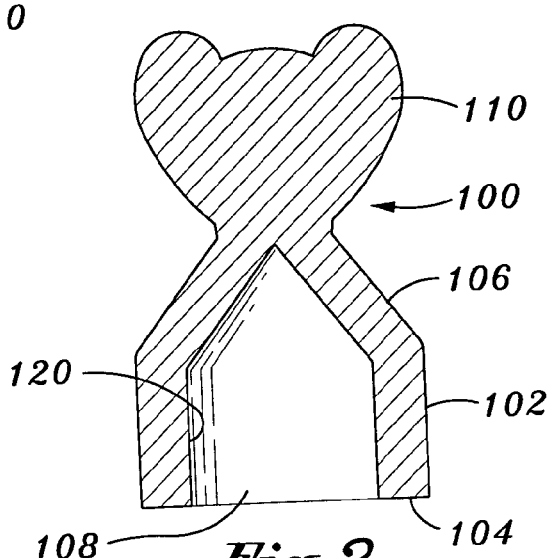
FIG. 2 is a section view of the accessory device taken from FIG. 1.

Referring now to the drawings wherein the showings are for purposes of illustrating preferred embodiments of the present invention only, and not for purposes of limiting the same, FIG. 1 and FIG. 2 illustrate a first embodiment of an accessory device 100 of the present invention. As shown, the accessory device 100 comprises a base 102. In the embodiment shown, the base 102 is largely cylindrical so as to define a bottom end 104 and a top end 106.

As is also shown, the device 100 includes an opening 108 that partially extends along the axis of the base 102 through the center of the bottom end 104. As such, the opening 108 defines an inner surface 120 of the base 102. In the preferred embodiment, the diameter of the opening 108 is sized to be slightly smaller than the maximum width of the button that is attached to many hat designs. For instance, in one embodiment, the opening 108 comprises a round aperture with a diameter of approximately 9/16 inches. As will be described in greater detail below, the opening 108 is sized so as to be axially pressed over the button and be removably retained thereon by friction between the inner surface 120 and the exterior diameter/perimeter of the button.

Furthermore, the device 100 includes a display object 110. In the embodiment shown, the display object 110 comprises a cartoonish replica of an animal head; however, it is understood that the display object 110 could comprise a vast array of three-dimensional objects without departing from the spirit of the invention. For instance, the display object 100 could comprise a figurine of another animal, a sign, or other such object without departing from the spirit of the invention. As shown, the display object 110 is integrally attached to the top end 106 of the base 102 and extends upwardly therefrom for display atop the hat 112. As will be described below, once the device 100 is attached to a hat, the display object 110 makes the hat more aesthetically pleasing.

Figure 3:
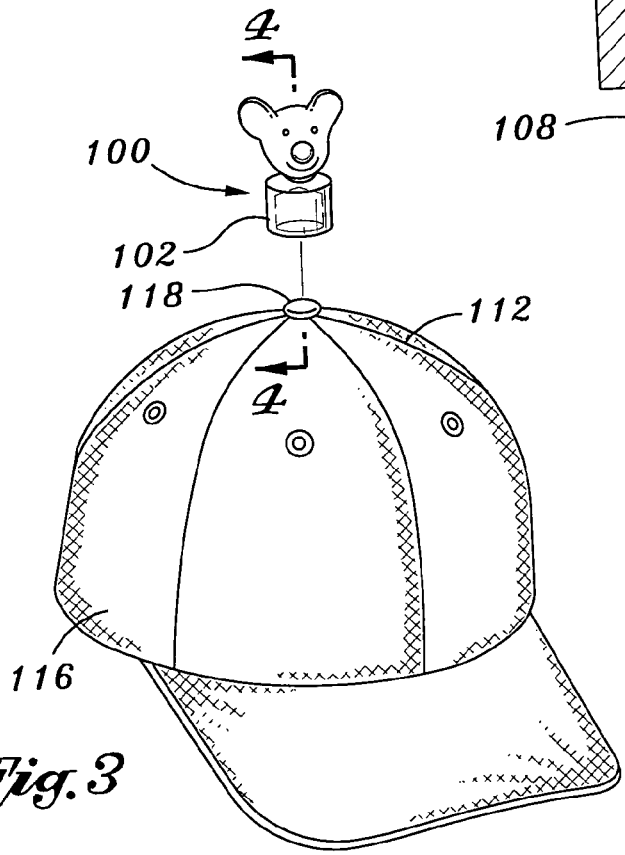
FIG. 3 is an exploded perspective view of the accessory device illustrating the attachment of the removable accessory device of FIG. 1 to a hat/cap.
Figure 4:
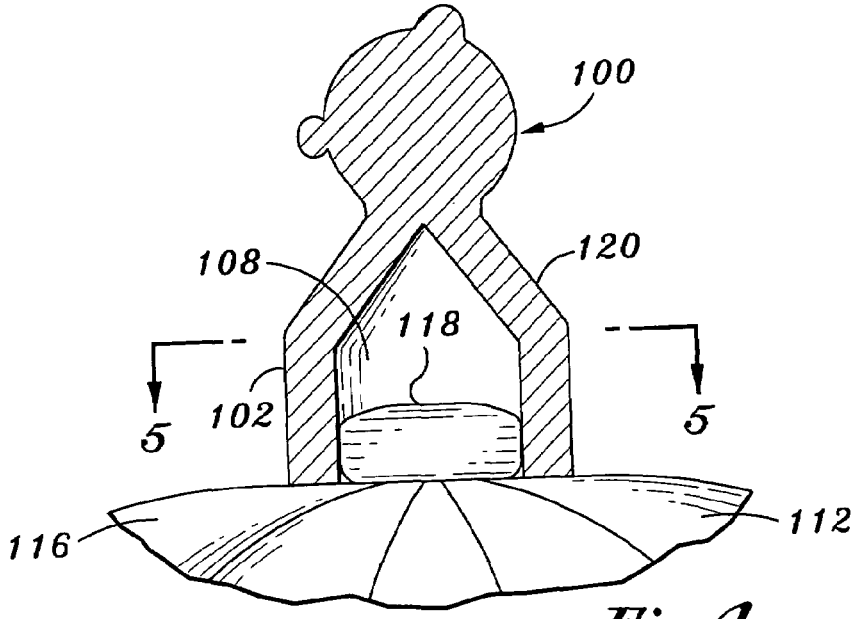
FIG. 4 is a detail section view of the removable accessory device from FIG. 1 shown frictionally attached to the button of a hat/cap.

Turning now to FIG. 3 and FIG. 4, the device is shown attached to a hat 112. As shown, the hat 112 includes a bowl-like covering portion 116, suitable for being fit over a person's head. As is typical with many hat styles, a central button 118 is included at the apex of the covering portion 116. As is commonly known, the button 118 is typically cylindrical in shape, and the axis of the button 118 typically points perpendicularly upward from the apex of the covering portion 116.

Figure 5:
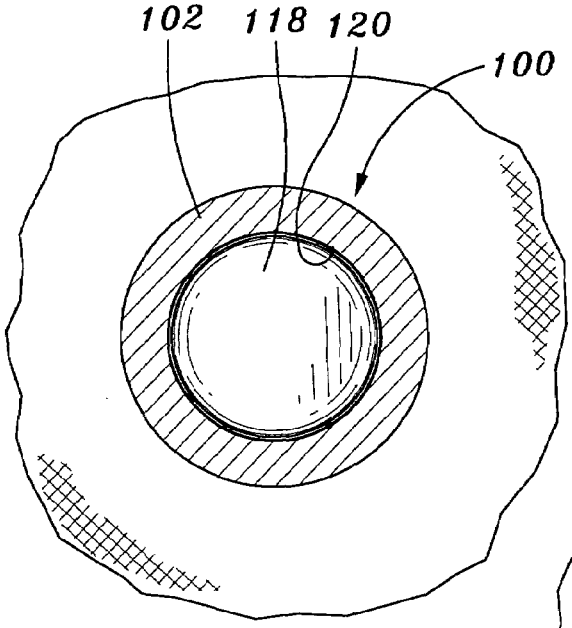
FIG. 5 is a top sectional view of the removable accessory device attached to a hat/cap, taken from FIG. 4.

As shown in FIGS. 3 through 5, in order to attach the device 100 to the hat 112, the axis of the opening 108 is aligned with the axis of the button 118. Then, the opening 108 is pushed axially over the diameter of the button 118. As stated above, the diameter of the opening 108 is sized to be slightly smaller than the diameter/perimeter of the button 118, such that a friction fit is generated between the inner surface 120 and the button 118 to securely hold the device 100 to the hat 112. Moreover, the button 118 is often covered in fabric, which further increases the friction fit between the button 118 and inner surface 120 of the device 100. Also, in order to remove the device 100, a user can axially pull the device 100 from the button 118.

Figure 6:
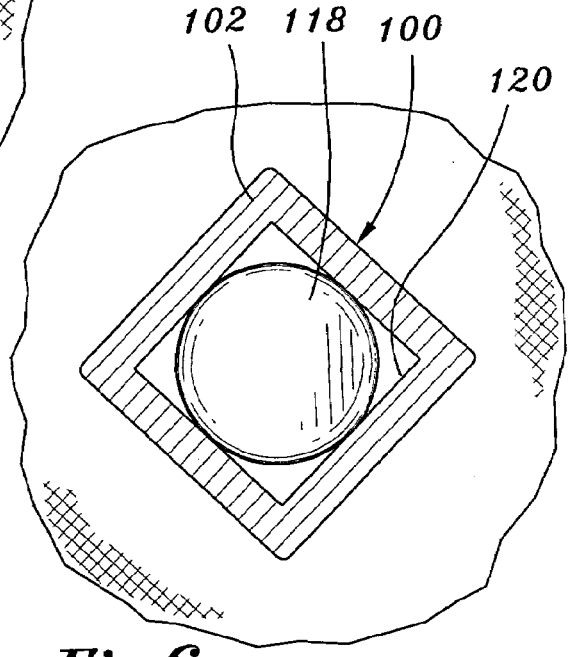
FIG. 6 is a top sectional view of an alternative embodiment of a removable accessory device attached to a hat/cap.

It is understood that the shape of the opening 108 may be changed in order to obtain an alternative frictional fit with the button 118 without departing from the spirit of the invention. For instance, in an alternative embodiment shown in FIG. 6, the opening 108 is square in shape and the button 118 is round. In this embodiment, the effective inscribed diameter (designated by the letter "d" in FIG. 6) of the opening 108 is sized to be slightly smaller than the maximum width (i.e., diameter) of the button 118, thereby causing a friction fit where the inner surface 120 tangentially contacts the button 118. Therefore, the opening 108 could take on a variety of shapes, including a circle, square, hexagon, octagon, and the like, and still achieve a frictional fit with the button 118.

In the first embodiment, the device 100 can be removably attached to the button 118 of a hat 112 through the use of a frictional fit therebetween. Such a device can be used to display messages, increase the aesthetic appeal of the hat, or be used in a variety of other ways. The frictional fit allows the device 100 to be easily attached and removed without the need for pins, snaps, or other attachment means. Also, unlike prior art devices described above (i.e., the devices disclosed in U.S. Pat. No. 5,530,970 to Knutson and U.S. Pat. No.

5,070,546 to Stazo), the device 100 does not require small members that locally flex to create the fit. Instead, the entire bottom end 104 flexes uniformly to accommodate the button 118 in a frictional fit. As such, it is much less likely that repeated attachment and removal of the device 100 would cause the device to fracture and prevent future attachment. Thus, the frictionally fitting device 100 is advantageously more robust.

Figure 7:
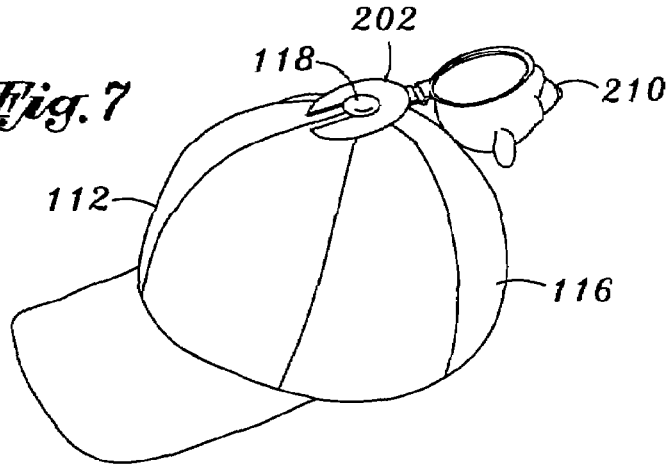
FIG. 7 shows an accessory device attached to the hat/cap in a second embodiment of the present invention.

FIGS. 7-10 shows a second embodiment of an accessory device 200 provided by the present invention. As shown in FIG. 7, the accessory device 200 includes an attaching unit 202 and a display object 210. The attaching unit 202 includes a base unit 204 for releasably attaching to a hat 112, and a snap-on unit 206 for attaching the display object 210 thereto. The base unit 204 and the snap-on unit 206 are connected to each other by a foldable/bendable bar or hinge 208. In FIG. 7, the base unit 204 is slide underneath the hat button 118, and the display object 210 is attached to the snap-on unit 206, which is disengaged with the base unit 204.

Figure 8:
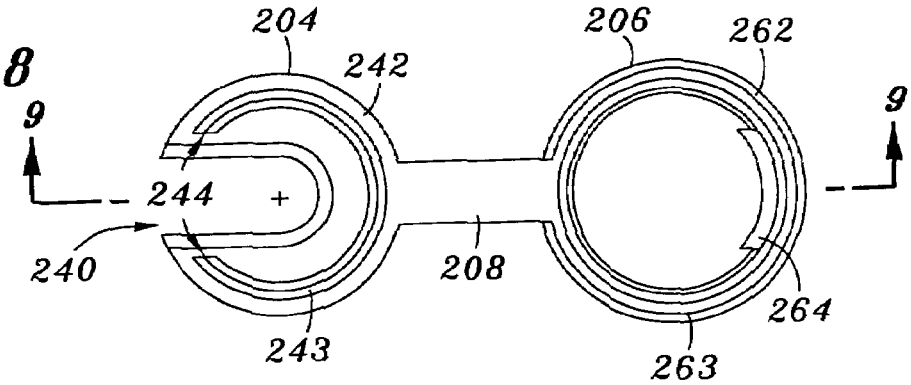
FIG. 8 shows a top view of an attaching means used to secure the accessory device as shown in FIG. 7 to the hat/cap.

FIG. 8 shows a top view of the attaching unit 202. As mentioned above, the attaching unit 202 includes the base unit 204 and the snap-on unit 206 connected to each other by the foldable bar or hinge 208. The base unit 204, the hinge 208 and the snap-on unit 206 can be integrally formed or separately formed and then connected together. The base unit 204 includes a bottom plate 242 with a slot 240 recessed from a periphery thereof. It will be appreciated that though the embodiment as shown provides a circular bottom plate 242, other geometry such as rectangle, triangle, ellipse, and polygon can also be applied to the bottom plate 242 without exceeding the spirit the present invention. Preferably, the slot 240 extends through the center of the bottom plate 204 and has a length shorter than the diameter (span) and longer than the radius (half span) of the bottom plate 242. The width of the slot 240 is smaller than the diameter of the hat button 118, such that the bottom plate 242 can be retained between the button 118 and the covering portion 116 even when the hat 112 is turned up side down. The base unit 204 further comprises a lower snap-on structure 243 protruding from a top surface of the bottom plate 242. The lower snap-on structure 243 also has an opening 244 aligned with the slot 240 and with a width larger than or equal to the width of the slot 240.

As shown in FIG. 8, the snap-on unit 206 includes a circular loop 262, an upper snap-on structure 263 protruding from a bottom surface of the circular loop 206, and a lid 264 extending inwardly from the snap-on structure 263. It will be appreciated that though a circular loop 206 is disclosed in this embodiment, the loop 263 can be formed in other shape such as rectangle, triangle, ellipse, and polygon without exceeding the spirit and scope of the present invention. Preferably, the periphery of the circular loop 206 is larger than that of the bottom plate 204, such that when the snap-on unit 206 is folded over and snapped on the base unit 206, the base unit 206 is covered by the snap-on unit 206.

Figure 9:
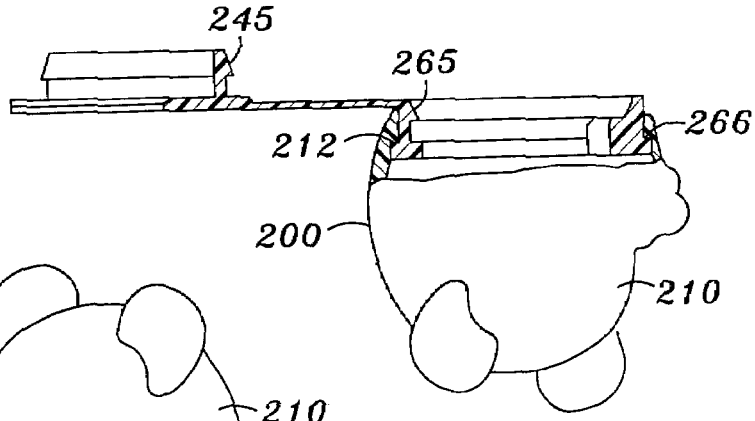
FIG. 9 shows a side view of the attaching means as shown in FIG. 8.
Figure 10:
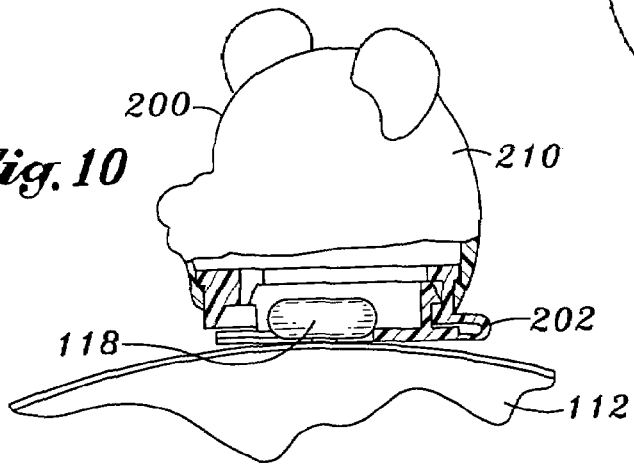
FIG. 10 shows an enlarged side view of the accessory device and a top portion of the hat.
Figure 11:
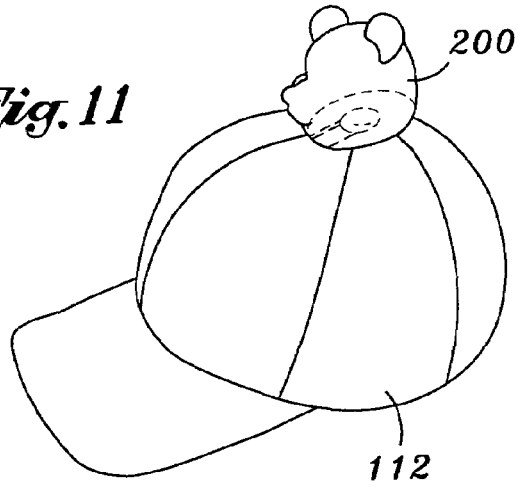
FIG. 11 shows the accessory device of FIG. 7 attached to the hat/cap.

Referring to the side view of the accessory device 200 in FIG. 9, the lower snap-on structure 243 of the base unit 204 includes an anchor 245 formed along an exterior surface thereof, while the upper snap-on structure 263 of the snap-on unit 206 includes a flexible latching structure 265 along an interior surface thereof. Therefore, by folding hinge 208, the snap-on unit 204 can be placed over the base unit 204, and snapped on the base unit 204. As shown in FIG. 9, the upper snap-on structure 263 further comprises a flange 266 along periphery thereof. The display object 210 has a contracted edge or a flexible latching structure 212 formed along an interior side of the bottom edge, such that the display object 210 can be pressed against and secured to the snap-on structure 206. As shown in FIGS. 10 and 11, when the object display 210 is attached to the snap-on unit 206, the snap-on unit 206 is flipped over the base unit 204 and snapped thereon, the accessory device 200 is thus secured to the hat 112. When the snap-on unit 206 is engaged with the base unit 204, the lid 264 is aligned with the openings 240 and 244 to avoid the accessory device slide laterally from the hat 112.

Figure 12:
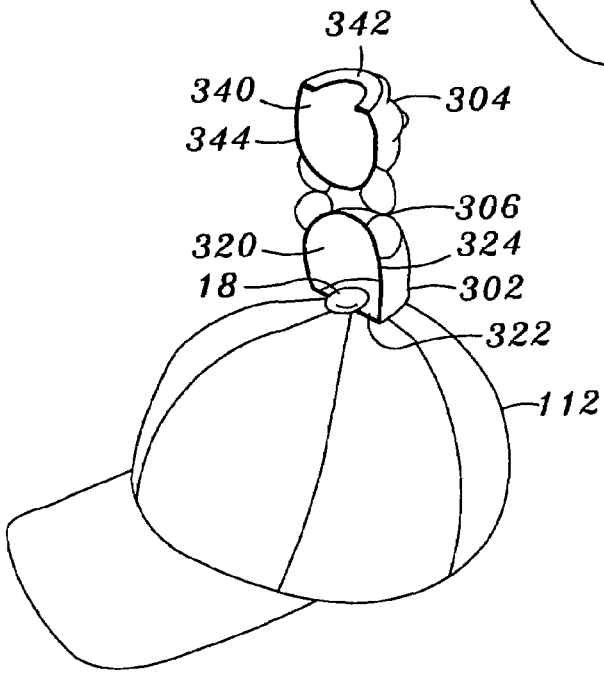
FIG. 12 shows an accessory device to be attached to a hat/cap in a third embodiment of the present invention.
Figure 13:
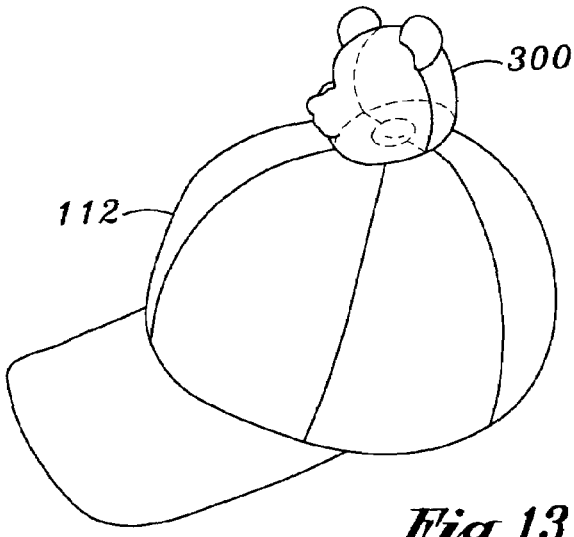
FIG. 13 shows the accessory device of FIG. 12 attached to the hat/cap;.
Figure 14:
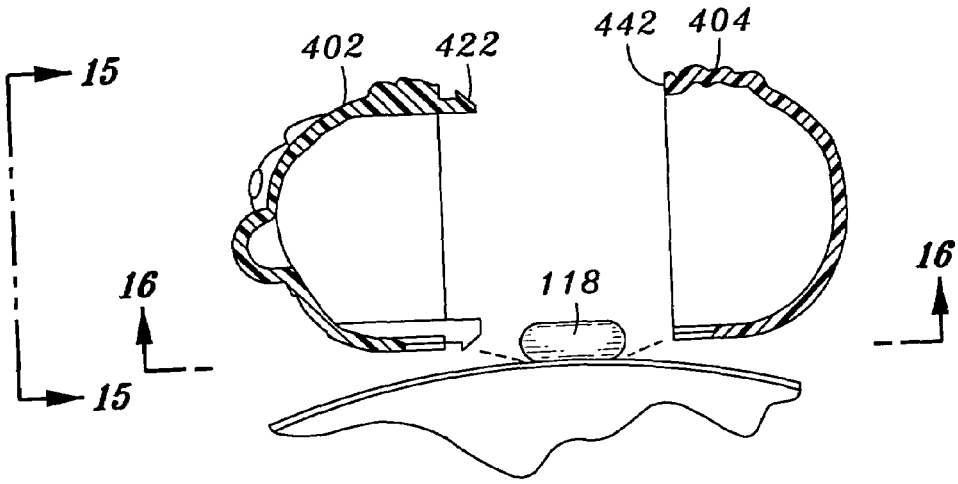
FIG. 14 shows an exploded side view of an accessory device to be secured to a hat/cap in a fourth embodiment of the present invention.

FIGS. 12 and 13 illustrate a third embodiment of an accessory device 300 provided by the present invention. The accessory device 300 includes two parts 302 and 304 each defining an edge 324, 344 conformal to the other. Depending on the specific exterior figure or profile of accessory device, the parts 302 and 304 are designed in regular or irregular three-dimensional geometries. As shown in FIG. 12, the parts 302 and 304 are partly connected to each other. In this embodiment, the top edges of the parts 302 and 304 are permanently connected to each other as hinge points 306. Therefore, these two parts 302 and 304 can be unfolded open, or folded to join together about the hinge points 306. When the parts 302 and 304 are folded together, the edges are aligned with each other to form the desired exterior figure or profiled of the accessory device as shown in FIG. 13. As shown in FIG. 12, the parts 302 and 304 comprise flat bottom surfaces 322 and 324, respectively. Each of the flat bottom surfaces 322 and 324 has a semi-circular notch; and when the parts 302 and 304 are joined together, the notches define a circular slot. Preferably, the diameter of the notches/slot is smaller than the diameter of the hat button 118. Therefore, in this embodiment, by sliding the bottom surface 322 of the part 302 underneath the hat button 118, the accessory device is partially attaching to the hat 112. The other part 304 is then folded down to join the part 302 with the bottom surface 324 sliding underneath the hat button 118 and joining the bottom surface 322. To retain the unfolded/folded state of the accessory device 300 while there is no external force applied thereto, and to further secure the accessory device 300 to the hat 112, the top edges of the parts 302 and 304 are preferably resiliently connected to each other at the hinge points 306. Or alternatively, fastening mechanism such as snap-on structure is preferably formed along the edges 324 and 344. The fastening mechanism will be further introduced in the following embodiment.

Figure 15:
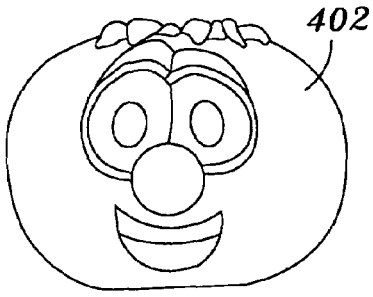
FIG. 15 shows a front view of the accessory device.
Figure 16:
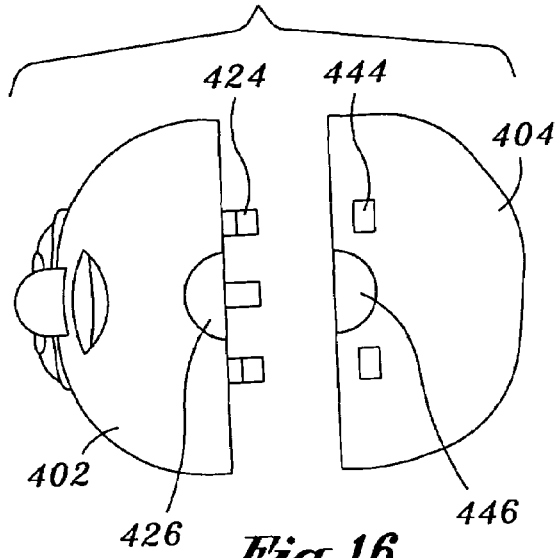
FIG. 16 shows a bottom exploded view of the accessory device.
Figure 17:
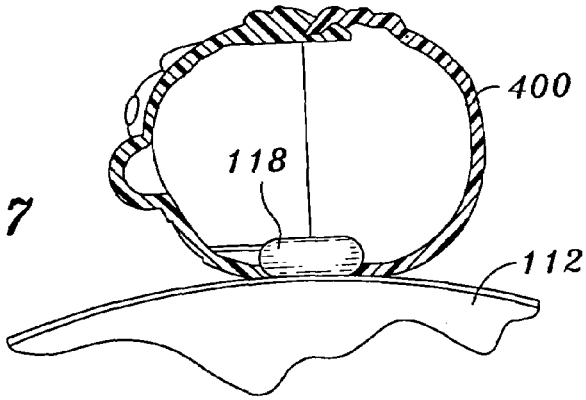
FIG. 17 shows a side view of the accessory device attached to the hat/cap.

FIG. 14 to 17 shows a fourth embodiment of an accessory device 400 provided by the present invention. Similar to the accessory device 400 as shown in FIGS. 12 and 13, the accessory device as shown in FIGS. 14 to 17 includes two conjugate parts 402 and 404 which can be detached from each other and joined together to form the desired display object. The parts 402 and 404 define the conformal edges 422 and 442, respectively. When the parts 402 and 404 are joined together, the edges 422 and 442 are aligned with each other. FIG. 15 shows the front side of the accessory device 400. FIG. 16 shows the bottom surfaces of the parts 402 and 404. As shown, the bottom surfaces of the parts 402 and 404 have semi-circular notches 426 and 446, which are aligned with each other to define a circular slot when the parts 402 and 404 are joined together. Along the edges 424 and 444, pairs of latching devices 424 and 444 are formed along the edges 422 and 444, respectively. As shown in FIG. 17, to secure the accessory device to the hat 112, the bottom surfaces of the parts 402 and 404 are slide underneath the hat button 118 with the notches 426 and 446 aligned therewith. The parts 402 and 404 are joined together with the edges 422 and 442 aligned with each other, and secured to each other by the latching devices 424 and 444. Similarly, the diameter of the slot defined by the notches 426 and 446 is preferably smaller than the diameter of the hat button 118, such that the accessory device will not fall even when the hat 112 is turned upside down.

FIGS. 18 to 21 show a fifth embodiment of an accessory device 500 provided by the present invention. The accessory device 500 includes an attaching unit 502 for releasably attaching to the hat 112, and a display object 504 removably attaching to the attaching unit 502. FIG. 18 shows an exploded view of the accessory device 500. In FIG. 18, the display object 504 is hollow at a lower portion thereof. The depth and width of the hollow portion 542 is no shorter than the length and width of the attaching unit 502, such that the attaching unit 502 can be received therein. The hollow portion defines a bottom rim 542, and along the interior side of bottom rim 542, a flexible latching structure 546 is formed. FIGS. 19 and 20 illustrate the top view and the bottom view of the latching unit 502, respectively. In this embodiment, the attaching unit 502 is a gripper clip with a top frame 522 and a plurality of arms 524 extending vertically from the top frame 522. The exterior surfaces of the arms 524 are in the form of anchors for mating the flexible latching structure 546 of the display object 504. Therefore, by aligning the hollow portion 542 over the attaching unit 502 and pressing the display object 504 against the attaching unit 502, the display object 504 is snapped on the attaching unit 502. As shown in FIG. 18, the ends of the arms 524 are contracted and slanted inwardly to form a gripping structure 526. By aligning the gripping structure 526 over the hat button 118 and pressing the gripping structure 526 over the hat button 118, the attaching unit 502 is secured to the hat 112 by slip gripping force.

In the above embodiments, the display object can be made of various kinds of materials such as PVC, and the base unit or the attaching unit can also be made of various kinds of materials. In one embodiment, the material for forming the base unit or the attaching unit includes polypropylene, for example.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed:

1. An accessory device that can be removably attached to a button of a hat, comprising:

a) an attaching unit including:

a base unit having a bottom plate including a slot recessed from a periphery of the bottom plate, the bottom plate slidable underneath the button, and a lower latching structure protruding from the bottom plate; and a snap-on unit having an upper latching structure on the interior surface of a periphery of the snap-on unit for engagement with the lower latching structure of the bottom plate and b) a display object attached to the snap-on unit of the base unit;

wherein the lower latching structure includes an opening aligned with the slot.

2. The device of claim 1, wherein the slot of the bottom plate extends along a length shorter than a diameter of the bottom plate.

3. The device of claim 1, wherein the device is formed via injection molding processes.

4. The device of claim 1, wherein the display object is a figurine.

5. The device of claim 1, wherein the base unit and the display snap-on unit are integrally formed.

6. The device of claim 1:

wherein an upper surface of the snap-on unit further comprises a flange along the periphery of the snap-on unit.

7. The device of claim 1, further comprising a foldable bar connecting the base unit and the snap-on unit as a hinge.

8. The device of claim 7, wherein the base unit, the snap-on unit and the foldable bar are integrally formed.

9. The device of claim 1, wherein the periphery of the base unit is smaller than the periphery of the snap-on unit.

10. The device of claim 6, wherein the display object includes a bottom rim configured to engageably mate with the flange of the snap-on unit.

11. The device of claim 1, wherein the snap-on unit further comprises a lid aligned with the opening when the upper latching structure is engaged with the lower latching structure.

* * * * *